US012667930B2

(12) United States Patent
Bozic

(10) Patent No.: US 12,667,930 B2
(45) Date of Patent: Jun. 30, 2026

(54) ADAPTER DEVICE FOR A POWER TOOL, POWER TOOL AND TOOL SYSTEM

(71) Applicant: Robert Bosch GmbH, Stuttgart (DE)

(72) Inventor: Milan Bozic, Luterbach (CH)

(73) Assignee: Robert Bosch GmbH, Stuttgart (DE)

( * ) Notice: Subject to any disclaimer, the term of this patent is extended or adjusted under 35 U.S.C. 154(b) by 795 days.

(21) Appl. No.: 17/637,980

(22) PCT Filed: Sep. 3, 2020

(86) PCT No.: PCT/EP2020/074572
§ 371 (c)(1),
(2) Date: Feb. 24, 2022

(87) PCT Pub. No.: WO2021/043889
PCT Pub. Date: Mar. 11, 2021

(65) Prior Publication Data

US 2022/0266411 A1 Aug. 25, 2022

(30) Foreign Application Priority Data

Sep. 4, 2019 (DE) ..... 10 2019 213 388.6

(51) Int. Cl.
*B24B 23/04* (2006.01)

(52) U.S. Cl.
CPC ..... *B24B 23/04* (2013.01)

(58) Field of Classification Search
CPC ..... B24B 45/00; B24B 23/04; B24B 23/02; B24B 23/028; B24B 23/00
See application file for complete search history.

(56) References Cited

U.S. PATENT DOCUMENTS 2,722,789 A * 11/1955 Robins ..... B24B 23/04 451/356
2,848,850 A 8/1958 Metoff
5,352,075 A 10/1994 Stephens
5,482,499 A * 1/1996 Satoh ..... B24B 45/00 451/344

(Continued)

FOREIGN PATENT DOCUMENTS

CN 105473282 A 4/2016
DE 29513470 U1 * 2/1996 ..... B24B 23/04

(Continued)

OTHER PUBLICATIONS

International Search Report corresponding to PCT Application No. PCT/EP2020/074572, mailed Jan. 13, 2021 (German and English language document) (5 pages).

*Primary Examiner* — Monica S Carter
*Assistant Examiner* — Kent N Shum
(74) *Attorney, Agent, or Firm* — Maginot, Moore & Beck LLP

(57) ABSTRACT

An adapter device for a power tool, in particular a multi-functional power tool that is able to be driven in an oscillating manner, has at least one machine interface for connecting to the power tool, in particular to a tool receptacle of the power tool, and at least one tool interface for connecting to a sanding tool, in particular to a sanding sheet. The machine interface have has a connecting plane which encloses an angle other than 0°, 90° and 180° with a connecting plane of the tool interface.

5 Claims, 6 Drawing Sheets

(56) References Cited

U.S. PATENT DOCUMENTS

| | | | | |
|---|---|---|---|---|
| 5,709,597 | A * | 1/1998 | Sarantitis | B24B 55/10 451/353 |
| 2002/0115396 | A1 * | 8/2002 | Sarantitis | B24B 23/005 451/350 |
| 2016/0288287 | A1 | 10/2016 | Gacoin et al. | |

FOREIGN PATENT DOCUMENTS

| | | | |
|---|---|---|---|
| DE | 198 00 045 | A1 | 9/1998 |
| DE | 10 2007 010 195 | B3 | 4/2008 |
| FR | 2 808 469 | A1 | 11/2001 |
| WO | 2005/070616 | A1 | 8/2005 |
| WO | 2018/212448 | A1 | 11/2018 |

* cited by examiner

ADAPTER DEVICE FOR A POWER TOOL, POWER TOOL AND TOOL SYSTEM

This application is a 35 U.S.C. § 371 National Stage Application of PCT/EP2020/074572, filed on Sep. 3, 2020, which claims the benefit of priority to Serial No. DE 10 2019 213 388.6, filed on Sep. 4, 2019 in Germany, the disclosures of which are incorporated herein by reference in their entirety.

BACKGROUND

There has already been proposed an adapter device for a power tool, in particular a multifunction power tool that can be driven in oscillation, comprising at least one machine interface for connection to the power tool, in particular to the tool receiver of the power tool, and comprising at least one tool interface for connection to an abrasion tool, in particular an abrasive sheet.

SUMMARY

The disclosure is based on an adapter device for a power tool, in particular for a multifunction power tool that can be driven in oscillation, comprising at least one machine interface for connection to the power tool, in particular to the tool receiver of the power tool, and comprising at least one tool interface for connection to an abrasion tool, in particular an abrasive sheet.

It is proposed that the machine interface have a connection plane that, with a connection plane of the tool interface, encloses an angle that is other than 0°, 90° and 180°.

Preferably, the power tool is realized as a multifunctional power tool, in particular having a function for abrasion, polishing, sawing, parting-off, cutting, milling, and/or scraping, in particular additionally with a suction extraction function for dust and/or any workpiece chips or the like. Preferably, the power tool is realized as a portable power tool, in particular as a portable multifunctional power tool that can be driven in oscillation. A "portable power tool" is to be understood here to mean, in particular, a power tool, for performing work on workpieces, that can be transported by an operator without the use of a transport machine. The portable power tool has, in particular, a mass of less than 40 kg, preferably less than 10 kg, and particularly preferably less than 5 kg. Preferably, the power tool has a drive unit. Preferably, the power tool has a transmission unit. Preferably, the tool receiver of the power tool can be driven in oscillation, in particular by the drive unit and the transmission unit. The drive unit is preferably realized as an electric motor. The drive unit preferably comprises a drive axis. The transmission unit is preferably realized as an oscillatory transmission. The transmission unit is preferably designed to convert a transmission of a rotary motion, in particular of a drive element such as, for example, a rotor shaft, of the drive unit about specially the drive axis, into an oscillatory motion, in particular of the tool receiver about the oscillation axis. "Designed" is to be understood to mean, in particular, specially configured, specially devised and/or specially equipped. That an object is designed for a particular function, is to be understood to mean, in particular, that the object fulfils and/or executes this particular function in at least one application state and/or operating state.

Preferably, the power tool has a housing unit. Preferably, the housing unit has a main extent that is substantially parallel to the drive axis. A "main extent" of an object in this case is to be understood to mean, in particular, an extent of the object that is parallel to a longest edge of a smallest geometric cuboid that only just completely encloses the object. "Substantially parallel" is to be understood here to mean, in particular, an alignment of a direction relative to a reference direction, in particular in a plane, the direction deviating from the reference direction by, in particular, less than 8°, advantageously less than 5°, and particularly advantageously less than 2°. It is conceivable for the housing unit to be realized substantially in the shape of a cylinder or a cuboid. It is conceivable for the housing unit to have a grip element or a plurality of grip elements. For example, the grip element(s) may be realized as grip bar(s), knob pad(s) or other external structure(s) such as, for instance, grooves or one or more recess(es). Also conceivable is at least one deformable grip element realized as a rubber pad or the like.

Preferably, the tool receiver of the power tool has at least one tool seating surface against which the abrasion tool and/or a saw tool can be placed. Preferably, the tool receiver comprises at least one axial securing element for axially securing the abrasion tool and/or the saw tool to the tool seating surface, in particular in a non-positive and/or positive manner. Preferably, the tool receiver comprises at least one torque transmission element for transmitting a torque to the abrasion tool and/or the saw tool. The torque transmission element may be realized, for example, as at least one pin projecting from the tool seating surface. Preferably, the tool receiver has a multiplicity of torque transmission elements, for instance eight, ten or twelve. It is also conceivable for the tool receiver to have at least one axial securing element designed to exert a magnetic force on an object to be coupled. It is conceivable for the tool receiver to comprise at least one permanent magnet that is aligned and/or arranged to exert the magnetic force.

By means of the adapter device, an abrasion tool, in particular a clamping element with an abrasive sheet, and/or a saw tool can preferably be connected to the power tool, in particular to the tool receiver of the power tool. Preferably, the tool interface, in particular of the adapter device, is realized in a manner similar to the tool receiver of the power tool. It is conceivable that abrasion tools and/or saw tools that can be connected to the tool receiver can be connected to the tool interface, in particular of the adapter device, in a similar manner. Preferably, the machine interface is realized so as to be complementary to the tool receiver. Preferably, the machine interface has at least one connection element, in particular recess, in particular a plurality of connection elements, in particular recesses, for receiving the pin(s) of the tool receiver. Preferably, the machine interface has a central recess, that in particular is larger than the at least one recess. Preferably, the machine interface is realized for precisely fitting connection to the tool receiver, in particular of the power tool. It is conceivable for the machine interface and the tool receiver to be realized for connection by means of twisting and/or sliding and/or by means of plugging together. Preferably, the adapter device is designed for a detachable connection to the power tool. It is conceivable for the adapter device to be firmly connected to the power tool and/or to be realized as a single piece, in particular as a single part, with the tool receiver. It is conceivable for the adapter device to be realized as a part of the power tool.

It is conceivable for an abrasion tool composed of an abrasive paper to be realized on a clamping element, the clamping element being designed to be connected to the tool interface, in particular of the adapter device. Preferably, the machine interface of the abrasion tool is arranged on the clamping element. Preferably, the clamping element comprises the machine interface of the abrasion tool.

It is conceivable for the adapter device to be realized as a single piece, in particular as a single part, with the tool interface. "As a single piece" is to be understood to mean, in particular, connected in a materially bonded manner, for example by a welding process, an adhesive process, an injection process, and/or another process considered appropriate by persons skilled in the art, and/or advantageously formed in one piece, as for example by being produced from a casting and/or by being produced in a single-component or multi-component injection molding process, and advantageously from a single blank.

A "connection plane" of an interface is to be understood to mean, in particular, a plane that is parallel to a largest outer side of a smallest geometric cuboid that only just completely encloses the interface, the extent of the connection plane in particular corresponding to the extent of the largest outer side of the smallest geometric cuboid. In particular, it is conceivable for the connection plane to be perpendicular to a central axis, in particular an axis of symmetry, of the associated interface.

Preferably, the tool interface, in particular of the adapter device, is spaced apart, in particular by at least 0.1 cm, preferably at least 0.5 cm and particularly preferably at least 1 cm, from the machine interface, in particular on a main body of the adapter device. It is conceivable for the tool interface, in particular of the adapter device, and the machine interface to have at least one point of contact in at least one operating state. Preferably, the angle between the connection plane of the machine interface and the connection plane of the tool interface, in particular of the adapter device, is realized between 0.1° and 89.9°, preferably between 5° and 70°, particularly preferably between 5° and 45°, and very particularly preferably between 10° and 30°. It is conceivable for the machine interface and the tool interface, in particular of the adapter device, to be arranged immovably, in particular rigidly or firmly, against each other. It is also conceivable for the machine interface and the tool interface, in particular of the adapter device, to be mounted so as to be movable relative to each another, in particular rotatable and or displaceable, in particular linearly displaceable, and/or deformable. It is conceivable for the adapter device to be made, at least partially, from a deformable material, such as an artificial or natural elastomer, in particular rubber. It is conceivable for the angle between the connection plane of the machine interface and the connection plane of the tool interface, in particular of the adapter device, to be realized so as to be variable under the action of a force.

The design of the adapter device according to the disclosure enables an advantageously dimensioned adapter device to be achieved. An advantageous arrangement of the tool interface, in particular of the adapter device, can be achieved. In particular, it is possible to achieve an advantageous weight of the adapter device in relation to an advantageous arrangement of the tool interface. The adapter device makes it possible, in particular, to achieve an advantageous interface extension, in particular interface offset, in particular for a power tool. In particular, the adapter device can achieve an advantageous power transmission, in particular from the power tool to an abrasion tool and/or to a saw tool. An advantageous interface geometry can be achieved, thereby making it possible, in particular, to achieve particularly ergonomic handling of the power tool. It is advantageously possible to enable work to be performed on regions that are difficult to access such as, for example, corners. An adapter device can be realized by which a coupling to a power tool and an abrasion tool and/or a saw tool can be established in an advantageously intuitive, in particular unambiguous, manner. A geometry can be achieved that makes it possible to realize an advantageous distance between the power tool and a workpiece on which work is to be performed, in particular for performing work on regions that are difficult to access. The geometry of the tool interface, in particular of the adapter device, in relation to the power tool can advantageously prevent extreme point loading of the abrasion tool and/or of the saw tool. A tilted basic position of the power tool can be achieved, in particular in an oscillating abrasion motion.

It is furthermore proposed that the adapter device have at least one bearing unit, in particular a rotary bearing unit or a linear bearing unit, that is designed to support the machine interface so that it is movable, in particular pivotable, with respect to the tool interface, in particular about an axis of inclination of the machine interface. Preferably, the bearing unit is realized as a rotary bearing unit. Preferably, the rotary bearing unit is arranged between the machine interface and the tool interface, in particular of the adapter device. Preferably, the rotary bearing unit is designed to pivotably support the machine interface with respect to the tool interface, in particular of the adapter device. Preferably, the rotary bearing unit has at least one axis of inclination that adjustably realizes the angle between the connection plane of the machine interface and the connection plane of the tool interface, in particular of the adapter device, between 0.1° and 89.9°. Preferably, the axis of inclination is parallel to the connection plane of the tool interface, in particular of the adapter device, and/or of the machine interface. It is conceivable that the bearing unit to be realized as a linear bearing unit. It is conceivable for the bearing unit to be realized both as a linear bearing unit and as a rotary bearing unit. Advantageous versatility of the adapter device can be achieved. In particular, a plurality of applications can advantageously be made possible by the adapter device.

It is furthermore proposed that the adapter device have at least one bearing unit, in particular the aforementioned, in particular a linear bearing unit, which has at least one linear bearing element, in particular tool linear bearing element, on which the tool interface is supported in a movable, in particular displaceable, manner, in particular at least relative to the machine interface. Preferably, the linear bearing unit comprises at least one linear bearing element, in particular tool linear bearing element, that is arranged on the tool interface, in particular of the adapter device. Preferably, the tool linear bearing element is designed to support the tool interface, in particular of the adapter device, in a linearly displaceable manner on the adapter device. It is conceivable for tool linear bearing element to be designed to support at least the tool interface, in particular of the adapter device, in a linearly movable, in particular displaceable, manner with respect to the base element. It is conceivable for the at least one linear bearing element, in particular the tool linear bearing element, to be realized as a linear guide, in particular as a guide rail or the like. It is conceivable for the at least one linear bearing element, in particular the tool linear bearing element, to be realized as a linear guide having at least one element guided in a groove. An advantageous displaceability of the base element can be achieved, which can particularly advantageously effect a partial raising or a partial tilting of the machine interface, in particular as a result of the base element being realized in a wedge shape. It is advantageously possible to achieve an adapter device that, in particular by means of a linear bearing support, realizes an advantageously continuously adjustable angle between the connection plane of the machine interface and the connection plane of the tool interface, in particular of the adapter device.

It is furthermore proposed that the adapter device have at least one bearing unit, in particular the aforementioned, in particular a linear bearing unit, which has at least one linear bearing element, in particular machine linear bearing element, on which the machine interface is supported in a movable, in particular displaceable, manner. Preferably, the linear bearing unit comprises at least one linear bearing element, in particular machine linear bearing element, that is arranged on the machine interface. Preferably, the machine linear bearing element is designed to support at least the machine interface in a linearly displaceable manner on the adapter device, in particular at least relative to the tool interface, in particular of the adapter device. It is conceivable for the machine linear bearing element to be designed to support at least the machine interface in a linearly movable, in particular displaceable, manner with respect to the base element, in particular at an end or at an outer region of the machine interface. It is conceivable for the at least one machine bearing element to be realized as a linear guide, in particular as a guide rail or the like. It is conceivable for the at least one machine bearing element to be realized as a linear guide having at least one element guided in a groove. It is advantageously possible to achieve an adapter device that, in particular by means of a linear bearing support on the machine interface, achieves an advantageously settable, in particular extendable, radius of action, in particular at least in comparison with an adapter device that has an immovable machine interface, for a power tool.

It is furthermore proposed that the adapter device have at least one fixing unit, which has at least one fixing element that is designed to fix the tool interface relative to the machine interface in at least one angular position. Preferably, the rotary bearing unit of the adapter device can be fixed by the fixing unit in at least one angular position, in particular between 0.1° and 89.9°. Preferably, the fixing unit is designed to fix the rotary bearing unit in a multiplicity, in particular a continuum, of angular positions between 0.1° and 89.9°. It is conceivable that the fixing unit can fix the adapter device in at least one single angular position. Preferably, the fixing unit can fix the adapter device in at least two, preferably at least four, particularly preferably at least six angular positions, and very particularly preferably in at least ten angular positions, in particular in every 10° subinterval of angular positions, between 0.1° and 89.9°. The fixing unit preferably comprises a fixing element that is realized, in particular, as a latching element. It is conceivable for the fixing element of the fixing unit to comprise at least one adjusting element such as, for example, a setscrew, that in particular enables fine adjustment, in particular up to tenths of a degree, of the angle. It is possible to realize an adapter device that realizes a variable angle that can advantageously be fixed in at least one angular position for a work operation.

It is furthermore proposed that the adapter device have at least one base element on which the tool interface, in particular of the adapter device, and the machine interface are arranged, and which is realized at least substantially in a wedge shape. Preferably, in at least one design of the adapter device, the base element is realized so as to be at least substantially immovable, in particular without any a bearing unit. Preferably, in at least one design of the adapter device, the bearing unit, in particular the rotary bearing unit and/or the linear bearing unit, is arranged on the base element. In particular, the bearing unit may be designed to support the base element in a movable manner relative to the machine interface or to the tool interface, in particular of the adapter device. It is conceivable for the base element to have a rotary bearing unit, in particular the aforementioned, that is designed such that the side of the base element on which the machine interface is arranged is realized so as to be rotatable with respect to the side of the base element on which the tool interface, in particular the adapter device, is arranged. It is conceivable for the linear bearing unit to comprise a tool linear bearing element, in particular the aforementioned, that supports the tool interface, in particular of the adapter device, on the base element in a movable, in particular displaceable, manner. It is conceivable for the linear bearing unit to comprise a machine linear bearing element, in particular the aforementioned, that supports the machine interface on the base element in a movable, in particular displaceable, manner. It is conceivable for the adapter device is realized without the bearing unit, and for the tool interface, in particular of the adapter device, and the machine interface to be realized as a single part with the base element, which is realized in a wedge shape. Preferably, the base element has a triangular outer contour in at least one cross-section. Preferably, the base element, in at least one cross-section, has an outer contour composed of a triangle and a rectangle, in particular one side of the triangle forming one side of the rectangle. Preferably, the machine interface is arranged on an outer side of the base element. Preferably, the tool interface, in particular of the adapter device, is arranged on an outer side of the base element. The base element is preferably made from a solid material such as, for example, a plastic and/or metal. It is conceivable for the base element to delimit a cavity. Alternatively, it is conceivable for the base element to be realized without a cavity. Preferably, the base element has at least one beveled and/or rounded edge, in particular an outer edge. It is conceivable for the base element to be realized as a skeleton, in particular a frame, having at least one cutout, in particular around a cavity. It is conceivable for the base element to be formed from a single part, in particular a metal part and/or a plastic part. It is conceivable for the machine interface and the tool interface, in particular of the adapter device, to be arranged on two largest outer surfaces of a base element, in particular a wedge-shaped base element. It is conceivable for the base element to be realized as part of the bearing unit and/or of the fixing unit. It is conceivable that the tool interface, in particular of the adapter device, and the machine interface can be moved relative to each other by means of the base element. It is conceivable that the angular position of the tool interface, in particular of the adapter device, can be set relative to the machine interface by means of the base element. It is conceivable for a fixing element to be arranged on the base element. It is possible to achieve a structurally simple adapter device that realizes the angle between the connection plane of the machine interface and the connection plane of the tool interface, in particular of the adapter device.

It is furthermore proposed that the adapter device have at least one air channel for passing particles, in particular chips, that extends from the tool interface to the machine interface and is realized curved by the angle in at least one operating state. Preferably, the air channel is arranged within the base element. It is conceivable for the air channel to be arranged outside the base element. Preferably, the air channel fluidically connects the machine interface to the tool interface, in particular of the adapter device, in particular the abrasion tool and/or the saw tool to the power tool and/or to an external dust extraction device. It is conceivable for the adapter device to have an air channel interface to which an air channel of an external dust extraction appliance can be attached. Preferably, the air channel is realized as a hose and/or tube. Preferably, the air channel is at least partially elastic and/or stretchable, for example realized as a bellows, made of a natural or artificial elastomer. Preferably, when the angle between the connection plane of the machine interface and the connection plane of the tool interface, in particular of the adapter device, is adjusted, the air channel, because of elastic constituents, can also realize the angle between the machine interface and the tool interface, in particular of the adapter device. Preferably, when the angle between the connection plane of the machine interface and the connection plane of the tool interface, in particular of the adapter device, is adjusted, a spring force contracts the air channel to a minimum extent. It is conceivable for the air channel to be substantially straight. "Substantially straight" in this context is to be understood to mean that the air channel is straight over at least 90% of its main extent, the openings of the air channel spanning respective opening planes that enclose the angle with each other. It is possible to realize an adapter device that realizes an advantageous arrangement between the machine interface and the tool interface, in particular of the adapter device, and that additionally can support an air suction extraction function of a power tool in a particularly advantageous manner. In particular, an air suction extraction function can be supported irrespective of the arrangement of the tool interface, in particular of the adapter device, in particular with respect to the machine interface. In particular, the adapter device can advantageously support an air suction extraction function at different angular settings of the adapter device.

It is furthermore proposed that the machine interface be realized as part of a ball joint. It is conceivable for the bearing unit to comprise a ball joint. Preferably, the tool interface, in particular of the adapter device, is firmly connected to a spherical ball joint element. Preferably, the machine interface has a recess, in particular a ball socket, that is designed to partially receive the ball joint element. Preferably, the ball joint element is designed to support the machine interface and the tool interface, in particular of the adapter device, on each other in a movable, in particular rotatable, manner. Preferably, the adapter device comprises the fixing unit that is designed to fix the machine interface and the tool interface, in particular of the adapter device, in an angular position realized by the ball joint. Advantageously, it can be achieved that the adapter device can be realized so as to be adjustable and, owing to the design as a ball joint, fouling of the bearing unit, in particular with abrasive particles such as chips, can advantageously be minimized.

Also proposed is a tool system comprising at least one power tool, in particular a multifunctional power tool that can be driven in oscillation, and comprising an adapter device. Preferably, the adapter device is realized separately from the power tool, and in particular is designed use with various abrasion tools and/or saw tools. Preferably, the power tool system comprises at least one charging unit, that is designed to supply the power tool with electrical energy. The charging unit may be realized as a cable for a direct electric power supply. The power tool may comprise a battery unit for supplying electrical energy to a motor of the power tool. The charging unit may be realized as a charging station or charging cable for the battery unit of the power tool. It is possible to provide a tool system having an adapter device that advantageously can be realized specifically for a tool receiver of the power tool. In particular, an arrangement of the tool interface of the adapter device that is specially designed for a power tool, in particular a particular power tool, can be achieved. A tool system can be achieved that is advantageously precisely adapted to an abrasion operation with an adapter device, in particular at locations that are difficult to access. A tool system can be achieved that advantageously has low production costs. An advantageously preassembled tool system, composed of an adapter device and a power tool, can be achieved.

The disclosure is additionally based on a power tool, in particular the aforementioned, in particular a multifunction power tool that can be driven in oscillation, comprising at least one drive unit, in particular the aforementioned, which has a drive axis, in particular the aforementioned, comprising at least one output unit, in particular the aforementioned, which has an output axis, in particular the aforementioned, and comprising at least one tool interface, wherein the drive axis is transverse to the output axis. It is proposed that the tool interface, in particular of the power tool, have a connection plane that in relation to the drive axis and/or to the output axis encloses at least one angle that is other than 0°, 90° and 180°. Preferably, the transmission drives a working spindle in a rotationally oscillating manner. Preferably, the output axis has an extent parallel to the main extent of the working spindle of the transmission. Preferably, the tool interface of the power tool is connected to the power tool. Preferably, the tool interface, in particular of the power tool, is realized as a single piece with the tool receiver of the power tool. Advantageously, working of regions that are difficult to access, such as corners, can be achieved. Advantageously, a geometry can be achieved that makes it possible to realize an advantageous distance between the power tool and a workpiece on which work is to be performed, in particular for performing work on regions that are difficult to access. An advantageous arrangement of the tool interface, in particular of the power tool, can be achieved, that in particular is firmly, in particular directly, connected to the power tool in any arrangement of the power tool. As a result of the tool interface being directly connected to the power tool, an advantageous wear-resistant, angled arrangement of the tool interface, in particular on the power tool, can be achieved. An advantageously compact power tool can be realized, which in particular has an increased robustness when used at an angle. An advantageous ease of use of a power tool can be achieved.

The adapter device according to the disclosure, the power tool according to the disclosure and/or the tool system according to the disclosure are/is not intended in this case to be limited to the application and embodiment described above. In particular, the adapter device according to the disclosure, the power tool according to the disclosure and/or the tool system according to the disclosure may have a number of individual elements, components and units that differs from a number stated herein, in order to fulfill an operating principle described herein. Moreover, in the case of the value ranges specified in this disclosure, values lying within the stated limits are also to be deemed as disclosed and applicable in any manner.

BRIEF DESCRIPTION OF THE DRAWINGS

Further advantages are given by the following description of the drawing. Five exemplary embodiments of the disclosure are represented in the drawing. The drawing, the description and the disclosure contain numerous features in combination. Persons skilled in the art will also expediently consider the features individually and combine them to create appropriate further combinations.

In the drawing.

DETAILED DESCRIPTION

Figure 1:
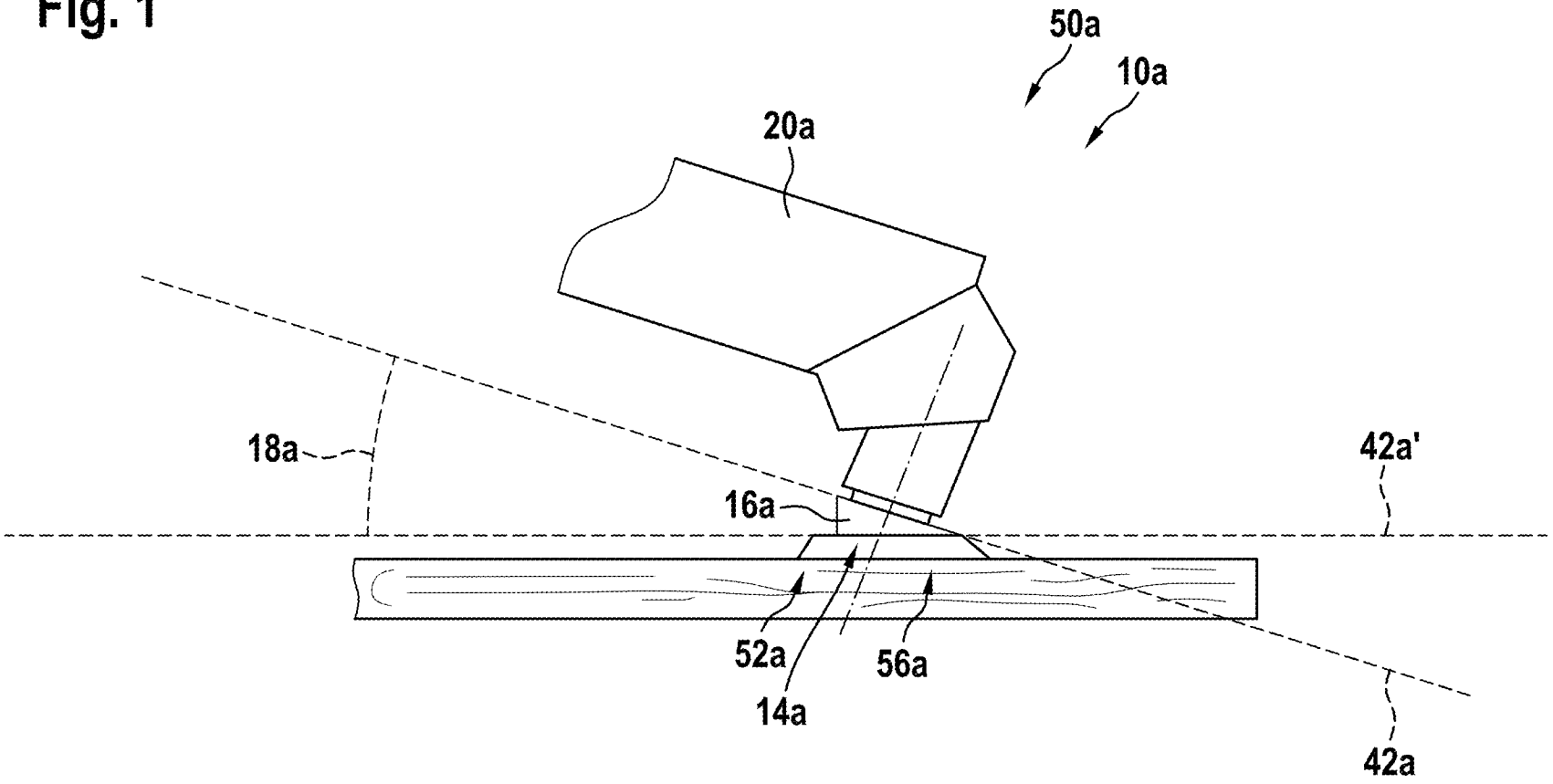
FIG. 1 shows a tool system according to the disclosure comprising an adapter device according to the disclosure, in a schematic representation.

FIG. 1 shows a tool system 50*a* comprising at least one power tool 20*a* and comprising at least one adapter device 10*a*. The power tool 20*a* is in particular constituted by a multifunction power tool that can be driven in oscillation. The adapter device 10*a* is designed for the power tool 20*a*, in particular the multifunction power tool that can be driven in oscillation.

Figure 2:
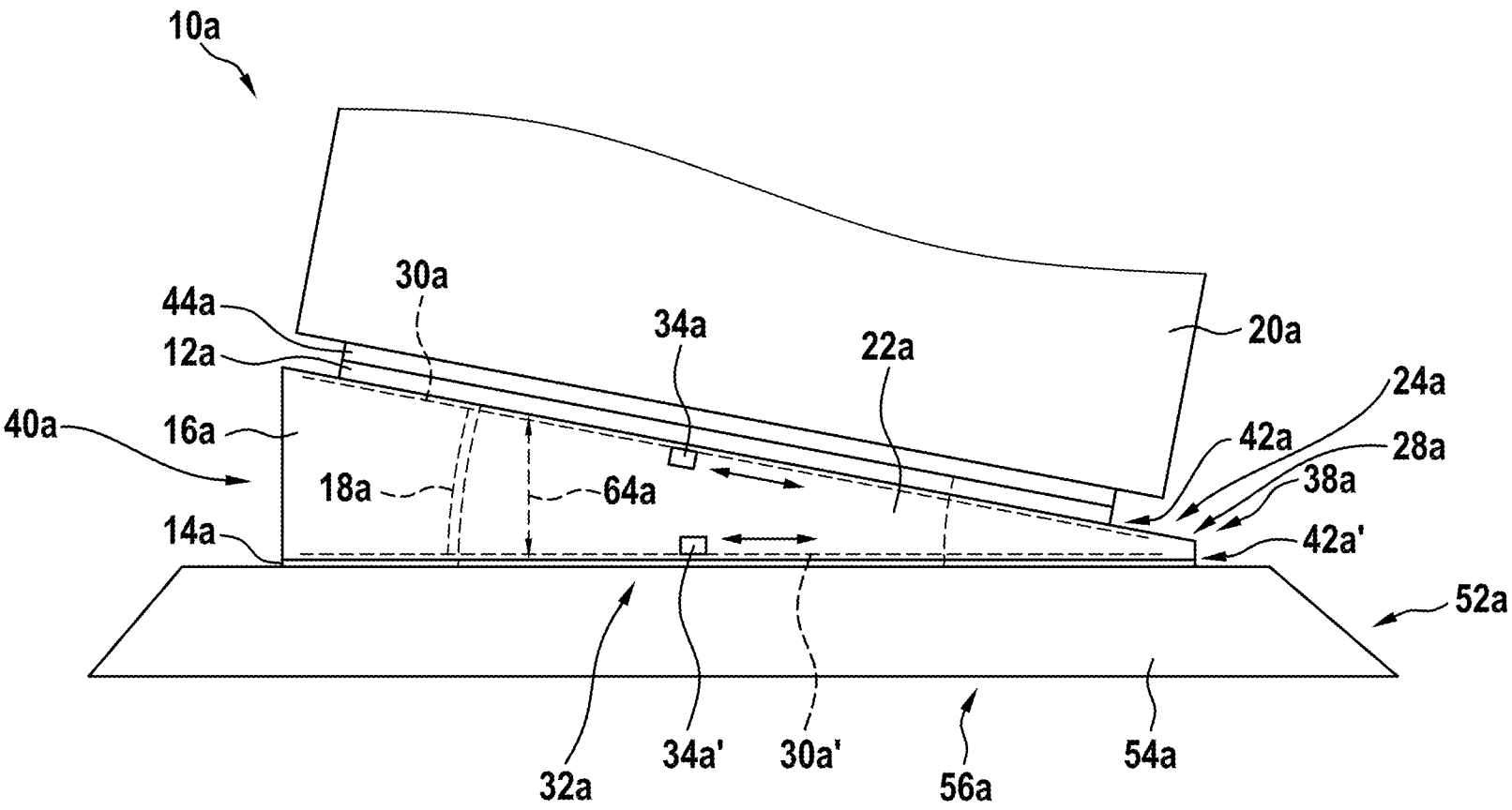
FIG. 2 shows the adapter device according to the disclosure, in a schematic representation.

FIG. 2 shows a detailed view of the adapter device 10*a* when having been removed from the power tool 20*a*. The adapter device 10*a* has a machine interface 12*a*. The adapter device 10*a* has a tool interface 14*a*. The adapter device 10*a* has at least one base element 16*a*. The machine interface 12*a* is arranged on the base element 16*a*. The tool interface 14*a*, in particular of the adapter device 10*a*, is arranged on the base element 16*a*. The tool interface 14*a*, in particular of the adapter device 10*a*, and the machine interface 12*a* are arranged on the base element 16*a*. The base element 16*a* is realized in a wedge shape. The base element 16*a* has a pointed end, in particular pointed end 38*a*. The base element 16*a* has a blunt end, in particular blunt end 40*a*. The base element 16*a*, in a cross-section perpendicular to a connection plane 42*a* of the machine interface 12*a* of the base element 16*a*, in particular along a connecting line from the pointed end 38*a* to the blunt end 40*a* of the base element 16*a*, has an outer contour which is composed of a triangle and/or a rectangle. The base element 16*a* may be realized as a metal wedge.

The tool interface 14*a*, in particular of the adapter device 10*a*, is designed for connection to an abrasion tool 52*a*, in particular an abrasive sheet 56*a*, and/or to a saw tool, in particular a saw blade. The abrasion tool 52*a* and/or saw tool comprise/comprises in particular a clamping element 54*a*, on which the abrasive sheet 56*a* and/or the saw blade are/is arranged. The machine interface 12*a* is designed for connection to the power tool 20*a*, in particular to a tool receiver 44*a* of the power tool 20*a*. The machine interface 12*a* is firmly connected to the power tool 20*a*, in particular to the tool receiver 44*a*. The machine interface 12*a* is arranged at a distance from the tool interface 14*a*, in particular of the adapter device 10*a*. A distance 64*a* of the machine interface 12*a* from the tool interface 14*a*, in particular of the adapter device 10*a*, is realized so as to increase from the pointed end 38*a* of the base element 16*a* towards the blunt end 40*a* of the base element 16*a*. The tool interface 14*a*, in particular of the adapter device 10*a*, is firmly connected to the abrasion tool 52*a*, in particular the clamping element 54*a*, and/or the saw tool. The clamping element 54*a* may in particular be realized as a flat plastic element, that in particular is of a size corresponding to the size of an abrasive sheet. It is conceivable for the clamping element 54*a* to realize a clamping angle, in particular between 0° and 90°, between the main extent of the abrasive sheet 56*a* and/or of the saw blade and a connection plane 42*a*'. It is conceivable for the clamping element 54*a* to be of a multipart design.

The machine interface 12*a* has the connection plane 42*a*. The tool interface 14*a*, in particular of the adapter device 10*a*, has a connection plane 42*a*'. The connection plane 42*a*, in particular of the machine interface 12*a*, encloses an angle 18*a* with the connection plane 42*a*' of the tool interface 14*a*, in particular of the adapter device 10*a*. The angle 18*a* is other than 0°, 90° and 180°. The angle 18*a*, in particular between the connection plane 42*a* of the machine interface 12*a* and the connection plane 42*a*' of the tool interface 14*a*, in particular of the adapter device 10*a*, is realized so as to be invariable. In FIG. 1 and FIG. 2, for example, the angle 18*a* is approximately 17.5°.

The adapter device 10*a* has at least one air channel 22*a* for passing particles, in particular chips. The air channel 22*a* extends from the tool interface 14*a*, in particular of the adapter device 10*a*, to the machine interface 12*a*. The air channel 22*a* is curved by the angle 18*a* in at least one operating state. In particular, the openings, in particular opening planes, of the air channel 22*a* at the machine interface 12*a* and the tool interface 14*a*, in particular of the adapter device 10*a*, are tilted relative to each other by the angle 18*a*.

The adapter device 10*a* has a bearing unit 24*a*, in particular linear bearing unit 28*a*. The linear bearing unit 28*a* has at least one linear bearing element 30*a*. The machine interface 12*a* is supported on the linear bearing element 30*a* in a movable, in particular displaceable, manner. The machine interface 12*a* is realized so as to be linearly displaceable, in particular along its connection plane 42*a*, with respect to the base element 16*a*. It is also conceivable, however, for the adapter device 10*a* to be realized without the bearing unit 24*a*, and for the machine interface 12 to be arranged in a fixed angular position relative to the tool interface 14*a*.

The linear bearing unit 28*a* has at least one further linear bearing element 30*a*'. The tool interface 14*a*, in particular of the adapter device 10*a*, is supported on the linear bearing element 30*a*' in a movable, in particular displaceable, manner. The tool interface 14*a*, in particular of the adapter device 10*a*, is realized so as to be linearly displaceable, in particular along its connection plane 42*a*', with respect to the base element 16*a*. The linear bearing elements 30*a*, 30*a*' may be realized, for example, as guide rails. The linear bearing elements 30*a*, 30*a*' are realized as a linear guide, in particular as a guide rail. It is conceivable for the linear bearing elements 30*a*, 30*a*' to be realized as linear guides, each having at least one element guided in a groove, such as, for example, a dovetail.

The adapter device 10*a* has a fixing unit 32*a* that comprises two fixing elements 34*a*, 34*a*'. The fixing elements 34*a*, 34*a*' are realized, for example, as latching elements or setscrews. The fixing elements 34*a*, 34*a*' are designed to prevent linear displacement of the tool interface 14*a*, in particular of the adapter device 10*a*, and of the machine interface 12*a* and to fix the tool interface 14*a*, in particular of the adapter device 10*a*, and the machine interface 12*a* in a defined position.

It is conceivable that arranged on the adapter device 10*a* there is at least one air channel interface that is designed for coupling to, in particular guiding, a flexible air channel 22*a*, that in particular is connected to an external air suction extraction device, in particular a vacuum cleaner.

It is conceivable for the adapter device 10*a*, in particular the base element 16*a*, to be firmly connected to the abrasion tool 52*a* and/or to the saw tool. It is conceivable for the adapter device 10*a*, in particular the base element 16*a*, to be realized as a single piece or as a single part with the abrasion tool 52*a* and/or the saw tool.

FIGS. 3 to 6 show a further exemplary embodiments of the disclosure. The following descriptions and the drawings are limited substantially to the differences between the exemplary embodiments and, in principle, reference may also be made to the drawings and/or the description of the other exemplary embodiment, in particular of FIGS. 1 to 2, in respect of components having the same designation, in particular in respect of components denoted by the same references. To distinguish the exemplary embodiments, the letter a has been appended to the references of the exemplary embodiment in FIGS. 1 to 2. In the exemplary embodiments of FIGS. 3 to 6, the letter a is replaced by the letters b to d.

Figure 3:
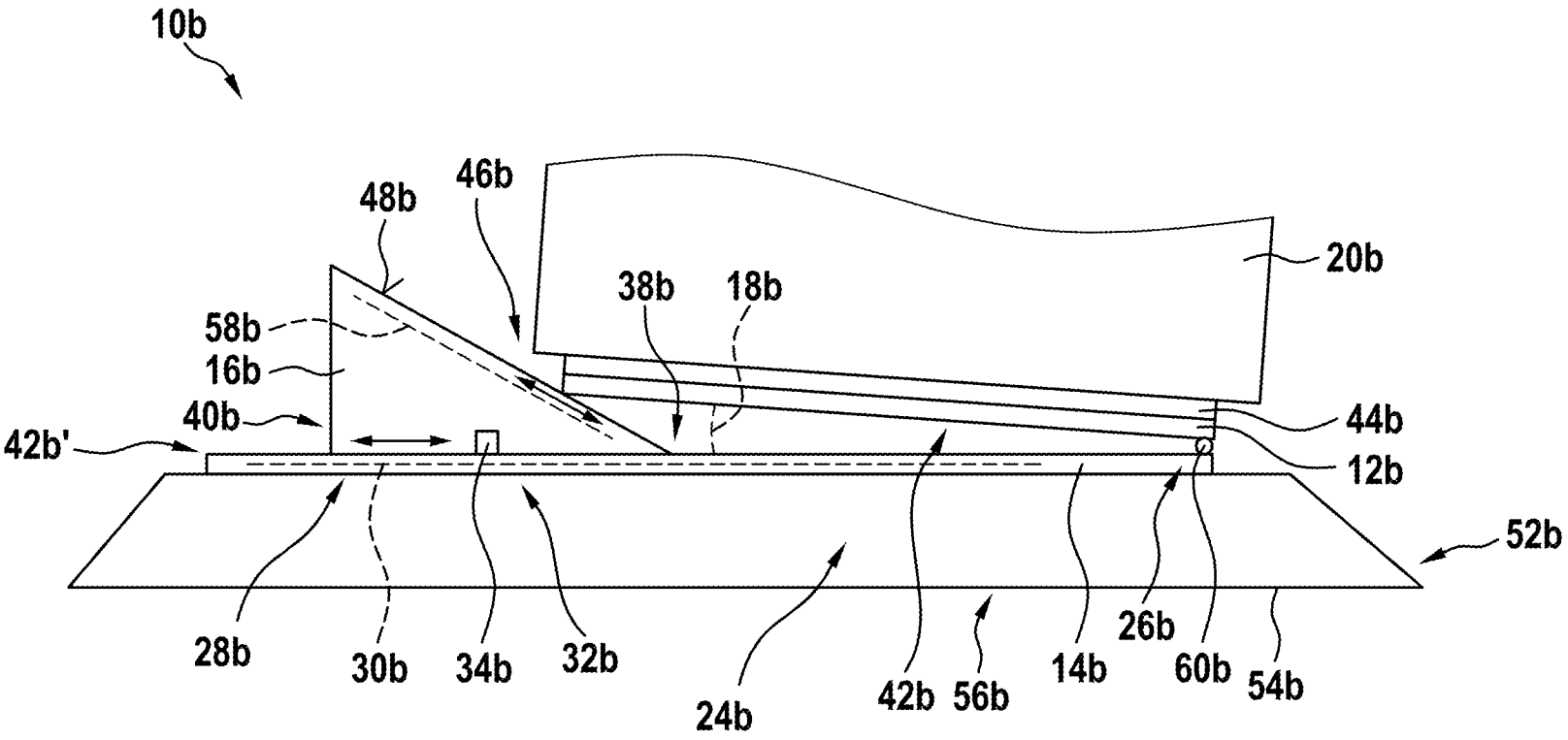
FIG. 3 shows an alternative adapter device according to the disclosure, in a schematic representation.

FIG. 3 shows an alternative embodiment of the adapter device 10*b* for a power tool 20*b* having a tool receiver 44*b*. The adapter device 10*b* comprises a base element 16*b*. The tool interface 14*b* is connected to an abrasion tool 52*b* that comprises a clamping element 54*b* and an abrasive sheet 56*b*, and/or to a saw tool that comprises at least one saw blade. The base element 16*b* is arranged between the machine interface 12*b* and the tool interface 14*b*. The base element 16*b* has an extent, from a pointed end 38*b* to a blunt end 40*b*, that is shorter than a maximum parallel extent of the tool interface 14*b*, in particular machine interface 12*b*. The base element 16*b* has a base surface 48*b* that faces away from the tool interface 14*b*.

The adapter device 10*b* comprises at least one bearing unit 24*b*, in particular rotary bearing unit 26*b*. The bearing unit 24*b*, in particular rotary bearing unit 26*b*, is designed to support the machine interface 12*b* so that it is movable, in particular pivotable, with respect to the tool interface 14*b*, in particular about an axis of inclination of the machine interface 12*b*. The rotary bearing unit 26*b* has a rotary bearing element 60*b*. The rotary bearing element 60*b* is arranged in a common end region of the machine interface 12*b* and of the tool interface 14*b*, in particular the connection plane 42*b* of the machine interface 12*b* and the connection plane 42*b*' of the tool interface 14*b*. The rotary bearing element 60*b* is connected to the tool interface 14*b* and the machine interface 12*b* in a common end region, in particular an outer end of an extent of the connection plane 42*b*, 42*b*' of the respective interface, the machine interface 12*b* and the tool interface 14*b*.

The base element 16*b* is supported so as to be displaceable along the machine interface 12*b*. The base element 16*b* is supported so as to be displaceable from the blunt end 40*b* in the direction of the pointed end 38*b*, in particular in the direction of the rotary bearing element 60*b* of the rotary bearing unit 26*b*, in order to achieve a defined angle 18*b* between the connection plane 42*b* of the machine interface 12*b* and the connection plane 42*b*' of the tool interface 14*b*. The rotary bearing unit 26*b*, in particular the rotary bearing element 60*b*, is realized, for example, as a hinge or pin, bolt, rivet and/or rivet with a rotary bearing support.

The adapter device 10*b* is designed for setting the angle 18*b*, in particular between the connection plane 42*b* of the machine interface 12*b* and the connection plane 42*b*' of the tool interface 14*b*. In particular, the rotary bearing unit 26*b* supports the machine interface 12*b* so that it is movable, in particular pivotable, with respect to the tool interface 14*b*.

The adapter device 10*b* comprises at least one bearing unit 24*b*' 24*b*, in particular a linear bearing unit 28*b*. The linear bearing unit 28*b* has at least one linear bearing element 30*b*. The base element 16*b* is supported on the linear bearing element 30*b* so as to be movable, in particular displaceable, in particular with respect to the tool interface 14*b*. It is conceivable for the bearing unit 24*b* to be realized as a rotary bearing unit 26*b* and as a linear bearing unit 28*b*. The angle 18*b* between the connection plane 42*b*' of the tool interface 14*b* and the connection plane 42*b* of the machine interface 12*b* is settable. The angle 18*b* between the connection plane 42*b*' of the tool interface 14*b* and the connection plane 42*b* of the machine interface 12*b* is settable, in particular between 0.1° and 45°, by a linear displacement of the base element 16*b* with respect to the tool interface 14*b*.

The machine interface 12*b* has a contact region 46*b* with the base element 16*b*. The contact region 46*b* shifts over the entire base surface 48*b* as the base element 16*b* is displaced. The machine interface 12*b* and the base element 16*b* are movably connected to each other, in particular in order to increase a stability of the adapter device 10*b*. In the exemplary embodiment shown, the contact region 46*b* is realized guided along a guide, in particular a linear guide 58*b* such as, for example, a groove. It is conceivable for a guide element of the guide to be arranged on and/or to the side of the base surface 48*b*, the guide element being connected to the machine interface 12*b* and guiding it along a defined, in particular curved, path as the base element 16*b* is displaced. The conceivable guide element may be realized, for example, as one or more guide rail(s).

The adapter device 10*b* has at least one fixing unit 32*b*. The fixing unit 32*b* has at least one fixing element 34*b* that is designed to fix the tool interface 14*b* relative to the machine interface 12*b* in at least one angular position. The fixing element 34*b* is designed to fix the base element 16*b* with respect to the tool interface 14*b*, in particular to fix the machine interface 12*b* in relation to the tool interface 14*b* in a defined angular position.

The fixing element 34*b* may be realized, for example, as a setscrew or latching element. The fixing element 34*b* is designed for setting the angle 18*b*. For example, the angle 18*b* may be set to within tenths of a degree by means of a setscrew as the fixing element 34*b*.

A defined angle 18*b* between the connection plane 42*b* of the machine interface 12*b* and the connection plane 42*b*' of the tool interface 14*b* can be achieved, in particular set, by a linear displacement of the base element 16*b* and fixing of the base element 16*b*.

It is conceivable for the contact region 46*b* to be unguided. It is conceivable for a fixing element 34*b*, designed to fix the adapter device 10*b* in a defined angular position to be arranged on the rotary bearing unit 26*b*. It is conceivable for a fixing element 34*b*, which fixes the rotary bearing unit 26*b* in an angular position with respect to the gravitational force of the adapter device 10*c*, in particular of the abrasion tool 52*b* and/or saw tool, of the machine interface 12*c* and of the base element 16*b*, and/or reversibly blocks further rotation at the rotary bearing unit 26*b*, to be arranged on the rotary bearing unit 26*b*

It is conceivable for the bearing unit 24*b*, in particular the linear bearing unit 28*b* and/or the rotary bearing unit 26*b*, and/or the fixing unit 32*b* to have at least one protective housing that is designed to protect a setting capability of the angle 18*b*, in particular a mobility, in particular against flying particles.

Figure 4:
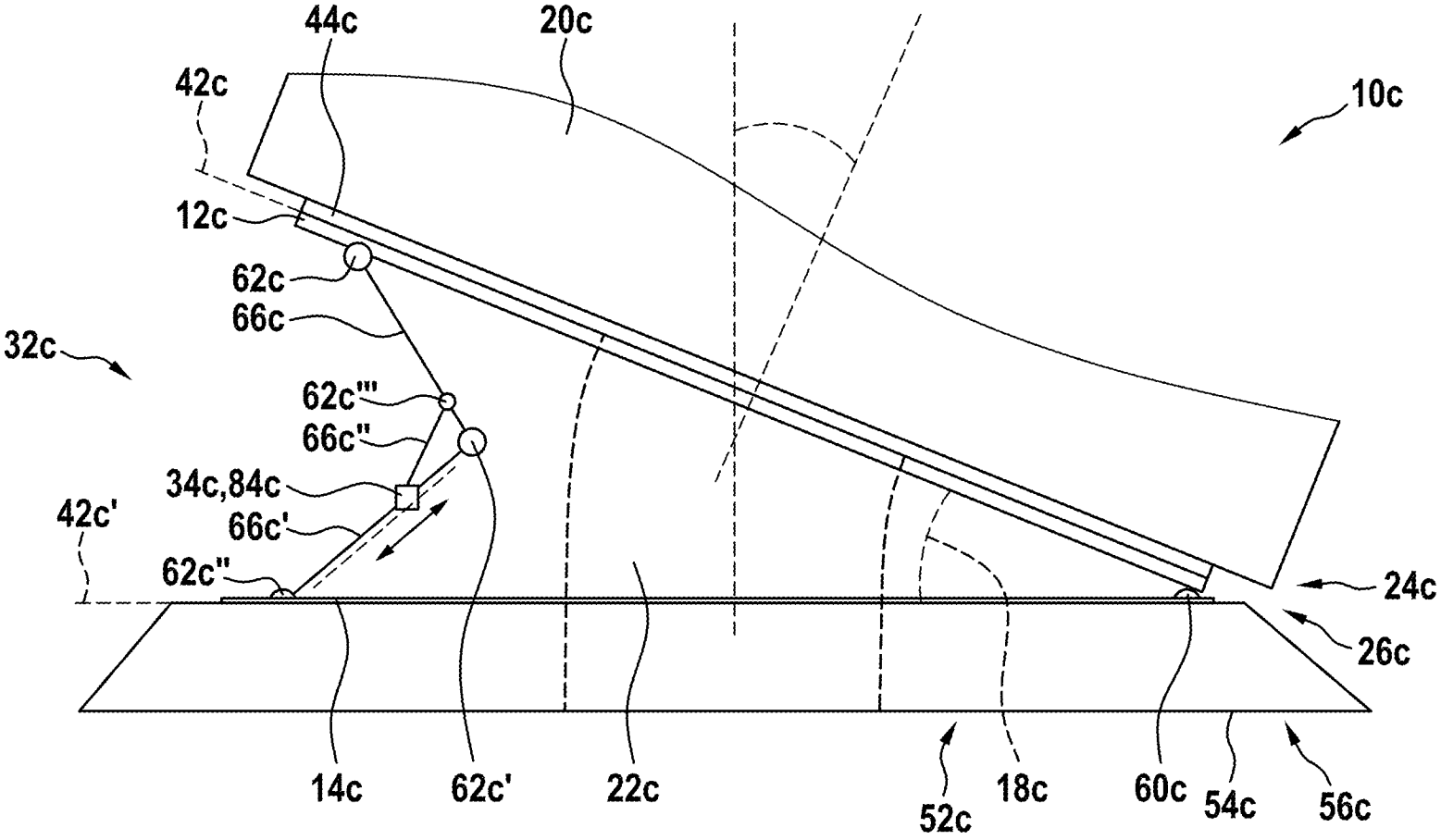
FIG. 4 shows an alternative adapter device according to the disclosure, in a schematic representation.

FIG. 4 shows an alternative embodiment of the adapter device 10*c*. The adapter device 10*c* is realized without an element that is analogous to the base element 16*b* of FIGS. 1 to 3. The tool interface 14*c* is connected to an abrasion tool 52*c* comprising a clamping element 54*c* and an abrasive sheet 56*c*, and/or to a saw tool comprising at least one saw blade. The machine interface 12*c* is connected to the tool receiver 44*c* of the power tool 20*c*.

The adapter device 10*c* comprises at least one bearing unit 24*c*, in particular rotary bearing unit 26*c*. The bearing unit 24*c*, in particular rotary bearing unit 26*c*, is designed to support the machine interface 12*c* so that it is movable, in particular pivotable, with respect to the tool interface 14*c*, in particular about an axis of inclination of the machine interface 12*c*. The rotary bearing unit 26*c* has a rotary bearing element 60*c*. The rotary bearing element 60*c* is arranged in a common end region of the machine interface 12*c* and of the tool interface 14*c*, in particular the connection plane 42*c* of the machine interface 12*c* and the connection plane 42*c*' of the tool interface 14*c*. The rotary bearing element 60*c* is connected to the tool interface 14*c* and the machine interface 12*c* in a common end region, in particular an outer end of an extent of the connection plane 42*c*, 42*c*′ of the machine interface 12*c* and/or of the tool interface 14*c*. The rotary bearing unit 26*c*, in particular the rotary bearing element 60*c*, is realized, for example, as a hinge or pin, bolt, rivet or rivets with a rotary bearing support. The adapter device 10*c* comprises a fixing unit 32*c*. The fixing unit 32*c* is arranged between the machine interface 12*c* and the tool interface 14*c*, in particular in an end region of the tool interface 14*c* and/or machine interface 12*c* opposite the rotary bearing element 60*c*. It is conceivable for the rotary bearing element 60*c* to be at least partially realized as a hinge. It is conceivable for the rotary bearing element 60*c* to be realized as a rod-like element through which the machine interface 12*c* and the tool interface 14*c* are supported in a movable manner.

The adapter device 10*c*, in particular the fixing unit 32*c* and/or the rotary bearing unit 26*c*, are/is designed for adjusting and/or fixing the angle 18*c*, in particular between the connection plane 42*c* of the machine interface 12*c* and the connection plane 42*c*′ of the tool interface 14*c*. In particular, by means of the rotary bearing unit 26*c*, the machine interface 12*c* is supported so that it is movable, in particular pivotable, with respect to the tool interface 14*c*. In particular, by means of the fixing unit 32*c*, the machine interface 12*c*, in particular the connection plane 42*c* of the machine interface 12*c*, can be fixed in an angular position with respect to the tool interface 14*c*, in particular the connection plane 42*c*′ of the tool interface 14*c*.

The fixing unit 32*c* comprises three fixing strips 66*c*, 66*c*', 66*c*". The fixing unit 32*c* comprises four pivot elements 62*c*, 62*c*', 62*c*", 62*c*'". The fixing strips 66*c*, 66*c*' are pivotally connected to each other at one end, in particular a middle end, of their main extents. The fixing strips 66*c*, 66*c*' are pivotably connected to each other via a pivot element 62*c*'. The fixing strips 66*c*, 66*c*' can in particular be pivoted past each other via the pivoting element 62*c*'. The swivel elements 62*c*, 62*c*', 62*c*", 62*c*'" may be realized as hinges or the like.

The fixing strip 66*c* is pivotably connected to the machine interface 12*c* at a further end, in particular a further end opposite the middle end, of its main extent. The fixing strip 66*c* is connected to the machine interface 12*c*, in particular pivotably, via the pivot element 62*c*. The fixing strip 66*c* is connected to the machine interface 12*c* in an end region of the machine interface 12*c* that opposite the rotary bearing element 60*c*. The middle ends of the fixing strips 66*c*, 66*c*' are the ends of the main extent of the fixing strips 66*c*, 66*c*' that are realized spaced apart from, in particular unconnected to, the tool interface 14*c* or the machine interface 12*c*.

The fixing strip 66*c*' is pivotably connected to the tool interface 14*c* at a further end, in particular a further end opposite the middle end, of its main extent. The fixing strip 66*c*' is connected to the tool interface 14*c*, in particular pivotably, via the pivot element 62*c*". The fixing strip 66*c*' is connected to the tool interface 14*c* in an end region of the tool interface 14*c* that opposite the rotary bearing element 60*c*.

The fixing strip 66*c* is, in particular in addition to the pivotable connection at the middle ends, connected to the fixing strip 66*c*' via the fixing strip 66*c*". The fixing strip 66*c*" is pivotably supported on/connected to one of the fixing strips 66*c*, 66*c*', in particular the fixing strip 66*c*, that is connected to the machine interface 12*c*, in particular at a distance from the middle end of the fixing strip 66*c*.

The fixing strip 66*c*" is slidably supported on/connected to one of the fixing strips 66*c*, 66*c*', in particular the fixing strip 66*c*', that is connected to the tool interface 14*c*, in particular spaced from the middle end of the fixing strip 66*c*′.

The fixing unit 32*c* comprises a fixing element 34*c*. The fixing element 34*c* is realized as a linear fixing element 84*c*. The fixing element 34*c* is arranged on the fixing strip 66*c*' in a linearly displaceable manner. The fixing element 34*c* is realized, for example, as a latching element. The fixing element 34*c* may, for example, latch into the fixing strip 66*c*" in various positions that can be achieved by displacement, in particular linear displacement, on the fixing strip 66*c*'. The fixing strip 66*c*" may be realized, for example, as a groove for guiding the latching element. The fixing strip 66*c* may have latching recesses for latching the fixing element 34*c*.

An air channel 22*c* is arranged between the machine interface 12*c* and the tool interface 14*c*. The air channel 22*c* is made, for example, from an elastomer, in particular as a bellows. In any operating state, the air channel 22*c* can realize the angle 18*c* at which the connection planes 42*c*, 42*c*' are located relative to each other. The air channel 22*c* has two openings. In particular, the openings of the air channel 22*c* are at the angle 18*c* with respect to each other in any angular position of the machine interface 12*c* and of the tool interface 14*c*, in particular of the adapter device 10*c*. In particular, the openings of the air channel 22*c* are arranged on the connection planes 42*c*, 42*c*' of the tool interface 14*c* and of the machine interface 12*c*. Between the openings, the air channel 22*c* may in particular be at least substantially straight.

Figure 5:
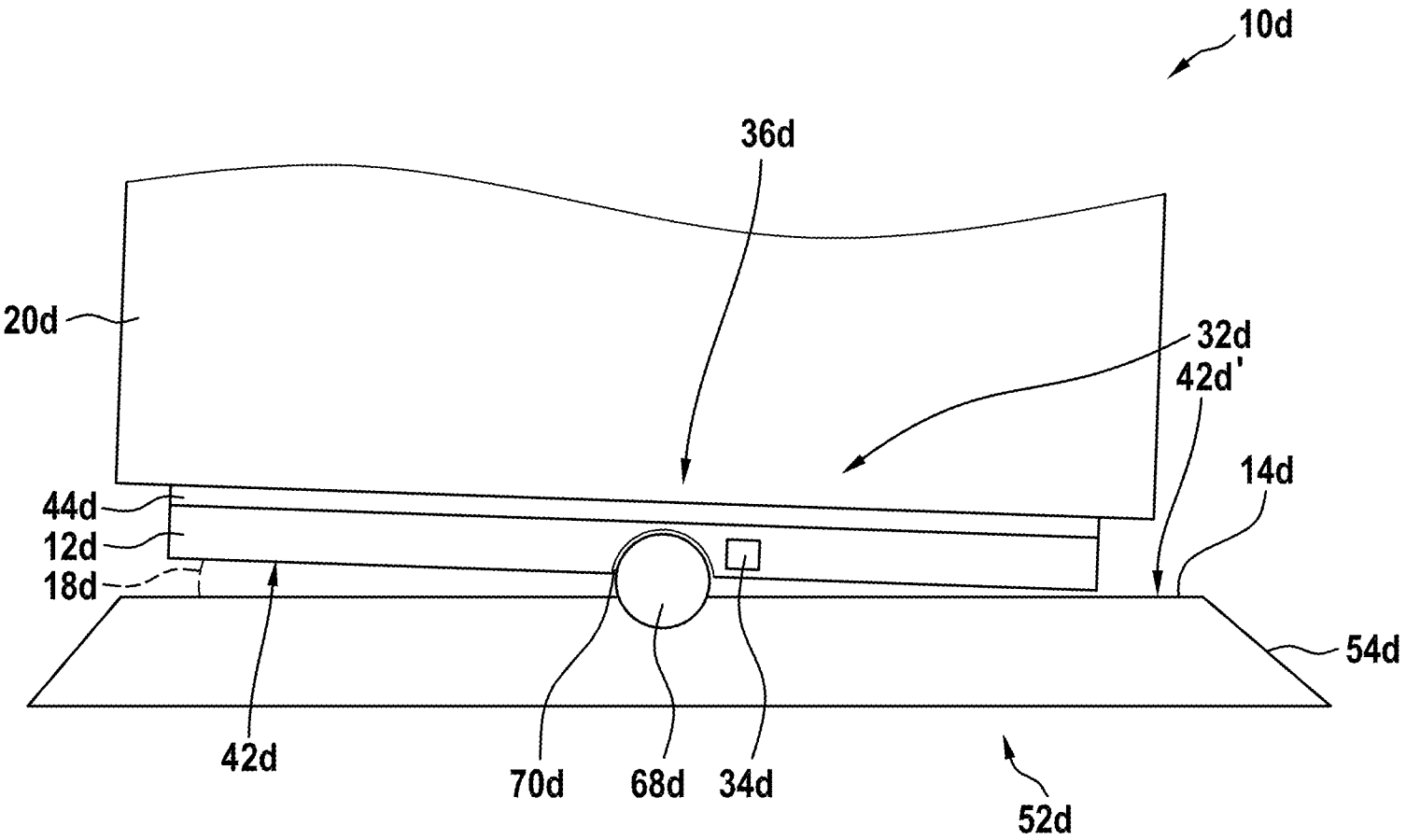
FIG. 5 shows an alternative adapter device according to the disclosure, in a schematic representation.

FIG. 5 shows an alternative embodiment of the adapter device 10*d* for a power tool 20*d* having a tool receiver 44*d*. In the example shown, the tool interface 14*d* is realized as a single piece, in particular as a single part, with the abrasion tool 52*d*, in particular the clamping element 54*d*, and/or the saw tool. It is conceivable for the clamping element 54*d* to be realized separately from the tool interface 14*d*, and to be connected to the tool interface 14*d*, in particular in a manner similar to the previous exemplary embodiments.

The tool interface 14*d* is firmly connected, in particular realized as a single piece or as a single part, with a ball element 68*d* of a ball joint 36*d*. The machine interface 12*d* is realized as part of a ball joint 36*d*. The machine interface 12*d* has a recess 70*d* for receiving the ball element 68*d*. The recess 70*d* is minimally larger than the ball element 68*d*. The machine interface 12*d* is movably supported on the tool interface 14*d* via the ball joint 36*d*. In particular, an angle 18*d* between the connection plane 42*d* of the machine interface 12*d* and the connection plane 42*d*' of the tool interface 14*d* can be set via the ball joint 36*d*.

A fixing element 34*d* of a fixing unit 32*d* is arranged on the ball joint 36*d*. It is conceivable for the fixing unit 32*d* to comprise a plurality of fixing elements 34*d*. For example, the fixing element 34*d* is realized as a clamping screw that reduces the effective inner radius of the recess 70*d* in such a way that the ball element 68*d* is clamped in the recess 70*d*. The angle 18*d* is realized so as to be fixable by the fixing element 34*d*.

It is conceivable for the fixing element 34*d* to be able to hold the ball joint 36*d* together in a position in which the angle 18*d* is unfixed. It is conceivable for the machine interface 12*d* to be arranged as a ball joint 36*d* on a, in particular wedge-shaped, element that in particular is realized in a manner similar to the base element 16*a* of the first exemplary embodiment as in FIGS. 1 and 2. It is conceivable for the ball joint 36*d* to be arranged the other way round, in particular to be firmly connected, in particular realized as a single piece or single part, with the machine interface 12*d*, and in particular for the tool interface 14*d* to have the recess 70*d* for receiving the ball element 68*d*.

Figure 6:
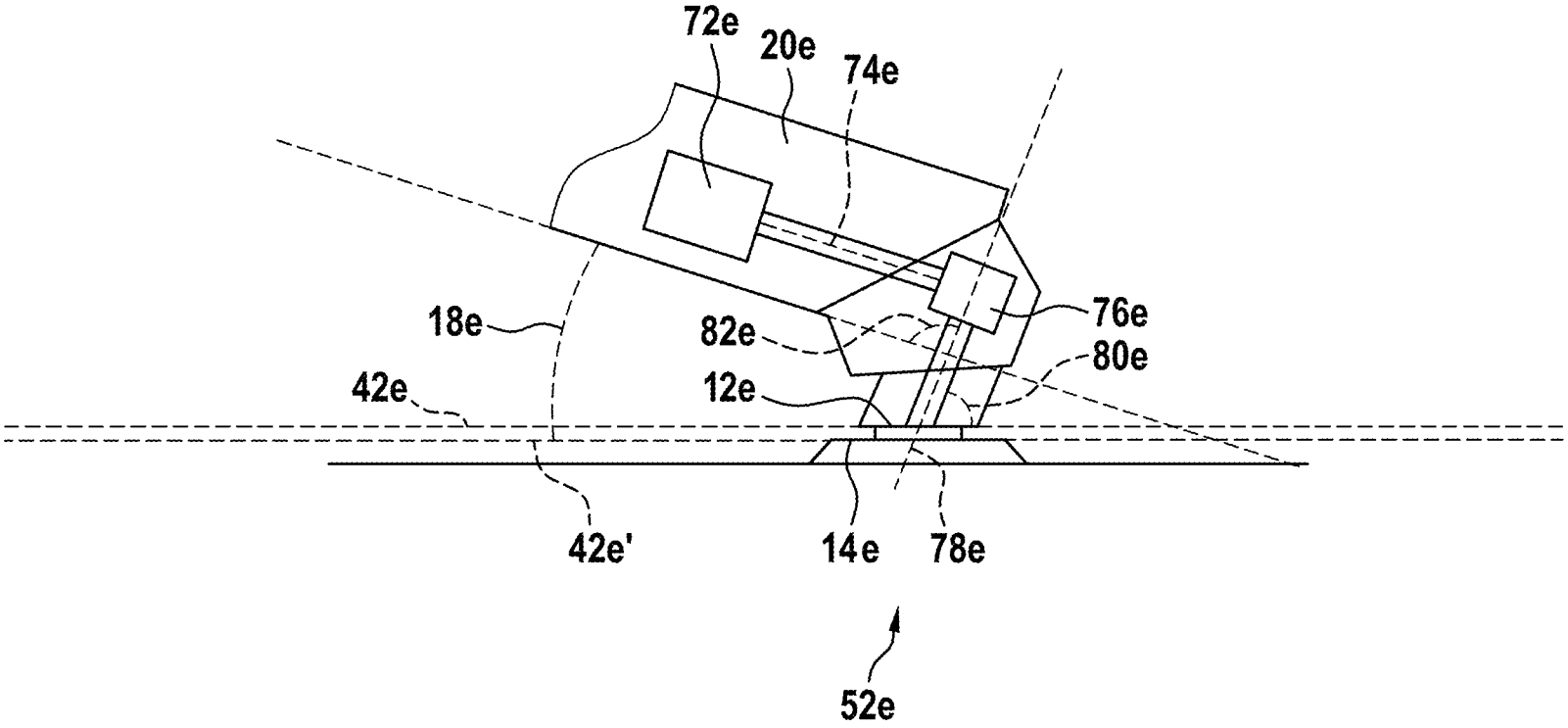
FIG. 6 shows a power tool according to the disclosure, in a schematic representation.

FIG. 6 shows a power tool 20*e*, in particular a multifunctional power tool that can be driven in oscillation. The power tool 20*e* is realized without an element, in particular an adapter device 10*a*, 10*b*, 10*c*, 10*d* as in FIGS. 1 to 5, for achieving an angle 18*d*. The power tool 20*e* has at least one drive unit 72*e*. The drive unit 72*e* is realized as an electric motor. The drive unit 72*e* has a drive axis 74*e*. The power tool 20*e* has at least one output unit 76*e*. The output unit 76*e* is realized as an oscillatory transmission, in particular for converting a rotary motion into an oscillatory motion. The output unit 76*e* has an output axis 78*e*. The output axis 78*e* is designed to transmit an oscillatory motion to an abrasion tool 52*e* and/or saw tool. The drive axis 74*e* is transverse to the output axis 78*e*.

The power tool 20*e* has at least one tool interface 14*e*. The power tool 20*e* has at least one machine interface 12*e*. The machine interface 12*e* has a connection plane 42*e*. The connection plane 42*e* encloses in relation to the drive axis 74*e* at least one angle 18*e* that is other than 0°, 90° and 180°. The connection plane 42*e* encloses in relation to the output axis 78*e* at least one angle 80*e* that is other than 0°, 90° and 180°. The connection plane 42*e* encloses in relation to the input axis 74*e* at least one angle 18*e* that is other than 0°, 90° and 180°. The connection plane 42*e* encloses in relation to the output axis 78*e* at least one angle 80*e* that is other than 0°, 90° and 180°.

The tool interface 14*e* has a connection plane 42*e*'. The connection plane 42*e*' encloses in relation to the drive axis 74*e* at least one angle 18*e* that is other than 0°, 90° and 180°. The connection plane 42*e*' encloses in relation to the output axis 78*e* at least one angle 80*e* that is other 0°, 90° and 180°. The connection plane 42*e*' encloses in relation to the input axis 74*e* at least one angle 18*e* that is other than 0°, 90° and 180°. The connection plane 42*e*' encloses in relation to the output axis 78*e* at least one angle 80*e* that is other than 0°, 90° and 180°.

The output axis 78*e* may be perpendicular to the input axis 74*e*. The output axis 78*e*, in particular for the purpose of transmitting force, in particular efficiently, extends at an angle 82*e* of between 30° and 90°, such as 45°, 60° or 75°, in relation to the input axis 74*e*. It is conceivable for the connection plane 42*e*' of the tool interface 14*e* or the connection plane 42*e* of the machine interface 12*e* to enclose with the drive axis 74*e* an angle 18*e* that is either 15°, 20°, 25°, 30° or 35°. In the exemplary embodiment shown, the angle 18*e* is realized as 17.5°.

The invention claimed is:

1. An adapter device for a multifunction power tool configured to be driven in oscillation, comprising:

at least one machine interface configured to connect to a tool seating surface of a tool receiver of the multifunction power tool that is designed to receive an abrasive sheet;

at least one tool interface configured to connect to the abrasive sheet, wherein the at least one machine interface has a connection plane that, with a connection plane of the at least one tool interface, encloses an angle that is other than 0°, 90° and 180°; and at least one rotary or linear bearing unit designed to support the at least one machine interface such that the at least one machine interface is movable relative to the at least one tool interface; and at least one fixing unit, which has at least one fixing element that is designed to fix the at least one tool interface relative to the at least one machine interface in at least one angular position, wherein the at least one tool interface is configured similar to the tool seating surface such that the at least one tool interface is designed to receive the abrasive sheet, wherein the at least one rotary or linear bearing unit includes a rotary bearing unit designed to support the at least one machine interface so that the at least one machine interface is pivotable, with respect to the at least one tool interface, about an axis of inclination of the at least one machine interface, wherein the rotary bearing unit comprises a rotary bearing element about which the at least one machine interface is pivotable relative to the at least one tool interface, wherein the rotary bearing element is connected to the at least one tool interface and the at least one machine interface in a common end region, wherein the rotary bearing element is configured as a hinge, and wherein the at least one fixing unit further comprises a plurality of fixing strips pivotably connected to one another by a plurality of pivot elements.

2. The adapter device as claimed in claim 1, further comprising an elastomeric bellows arranged between the at least one machine interface and the at least one tool interface, the elastomeric bellows defining an air channel fluidly connecting the at least one machine interface and the at least one tool interface.

3. A tool system comprising:

at least one multifunctional power tool configured to be driven in oscillation; and the adapter device as claimed in claim 1.

4. A multifunction power tool configured to be driven in oscillation, comprising:

at least one drive unit which has a drive axis;

at least one output unit which has an output axis, wherein the drive axis is transverse to the output axis;

a tool receiver having a tool seating surface designed to receive an abrasive sheet; and an adapter device comprising:

at least one machine interface configured to connect to the tool seating surface;

at least one tool interface configured to connect to the abrasive sheet, wherein the at least one tool interface has a connection plane that, in relation to the drive axis and/or to the output axis, encloses at least one angle that is other than 0°, 90° and 180°;

at least one rotary or linear bearing unit designed to support the at least one machine interface such that the at least one machine interface is movable relative to the at least one tool interface; and at least one fixing unit, which has at least one fixing element that is designed to fix the at least one tool interface relative to the at least one machine interface in at least one angular position, wherein the at least one tool interface is configured similar to the tool seating surface such that the at least one tool interface is designed to receive the abrasive sheet, wherein the at least one rotary or linear bearing unit includes a rotary bearing unit designed to support the at least one machine interface so that the at least one machine interface is pivotable, with respect to the at least one tool interface, about an axis of inclination of the at least one machine interface, wherein the rotary bearing unit comprises a rotary bearing element about which the at least one machine interface is pivotable relative to the at least one tool interface, wherein the rotary bearing element is connected to the at least one tool interface and the at least one machine interface in a common end region, wherein the rotary bearing element is configured as a hinge, and wherein the at least one fixing unit further comprises a plurality of fixing strips pivotably connected to one another by a plurality of pivot elements.

5. The power tool as claimed in claim 4, wherein the adapter device further comprises an elastomeric bellows arranged between the at least one machine interface and the at least one tool interface, the elastomeric bellows defining an air channel fluidly connecting the at least one machine interface and the at least one tool interface.

* * * * *